United States Patent [19]

Okabe

[11] Patent Number: 4,502,383

[45] Date of Patent: Mar. 5, 1985

[54] PRINT HEAD

[75] Inventor: Shinsuke Okabe, Tokyo, Japan

[73] Assignee: Monarch Marking Systems, Inc., Dayton, Ohio

[21] Appl. No.: 475,283

[22] Filed: Mar. 14, 1983

[51] Int. Cl.[3] ..... B41J 1/60

[52] U.S. Cl. ..... 101/111; 101/368; 101/382 R

[58] Field of Search ..... 400/95, 96, 97; 101/103, 105, 109, 111, 381, 382 R, 368, 405, 406, 379, 380, 383, 384, 396, 397, 398, 399

[56] References Cited

U.S. PATENT DOCUMENTS

| | | | |
|---|---|---|---|
| 880,225 | 2/1908 | Lamb et al. | 101/379 |
| 1,052,143 | 2/1913 | Hamilton | 101/111 |
| 1,420,376 | 6/1922 | Hellesoe | 101/406 X |
| 3,230,880 | 1/1966 | Beaver | 101/380 |
| 3,338,162 | 8/1967 | Davis | 101/405 X |
| 3,968,745 | 7/1976 | Hamisch, Jr. | 101/111 |
| 4,163,422 | 8/1979 | Hamisch, Jr. | 101/111 |
| 4,283,832 | 8/1981 | Hamisch, Jr. | 101/111 X |
| 4,290,358 | 9/1981 | Hamisch, Jr. | 101/111 |

*Primary Examiner*—Edgar S. Burr
*Assistant Examiner*—Charles A. Pearson
*Attorney, Agent, or Firm*—Joseph J. Grass

[57] ABSTRACT

There is disclosed a multi-line print head. In one embodiment, one line of the print head has a series of printing bands and another line has a printing member of generally U-shaped configuration. The printing bands and the printing members have printing characters disposed in a common printing plane or print surface and the printing characteristics of the printing bands and the printing member are substantially the same. The print head has two or more supports on which the printing bands and the printing member are supported. The print head also has a pair of side plates which straddle the supports, the printing bands and the printing member. The printing member can be readily inserted onto or removed from its related support member even after the print head has been assembled. In another embodiment, a U-shaped printing member is supported by a pair of supports.

3 Claims, 6 Drawing Figures

PRINT HEAD

BACKGROUND OF THE INVENTION

1. Field of the Invention

This invention relates to the art of print heads.

2. Brief Description of the Prior Art

The following U.S. patents of Paul H. Hamisch, Jr. are made of record: U.S. Pat. No. 3,968,745 granted July 13, 1976, 4,163,422 granted Aug. 7, 1979, 4,283,832 granted Aug. 18, 1981 and 4,290,358 granted Sept. 21, 1981.

SUMMARY OF THE INVENTION

It is a feature of the invention to provide a low-cost print head with the provision of an insertable printing member. The printing member can have a series of printing characters or elements for printing a message. The printing member can be easily inserted or removed from the printing position without even partially disassembling the print head. The printing member can be used with a support constructed to support a series of printing bands, without altering the structure of the support. The print head can have at least one series of settable printing bands having printing characters or elements for printing at least one line of variable indicia or characters as well as a printing member with substantially the same printing characteristics as the printing bands so that the quality of printing is similar for each of the printed characters.

Each series of printing bands is supported by a support and the printing member is preferably supported by a similar support.

A printing member according to a specific embodiment of the invention includes a pair of spaced arm portions having terminal ends and a connecting bight portion, with the arm and bight portions being in a transverse generally U-shaped arrangement, the bight portion providing a base having an outer surface containing printing characters extending in a lengthwise direction, the arm portions having opposed inner surfaces with inwardly extending projections, the printing member being of one-piece molded construction and being composed of elastomeric material so that the arm portions are spreadable to receive a support and being elastically returnable to grip the support. The support, the printing bands and the printing member are disposed between a pair of side plates. The printing member is readily insertable onto and removable from its related support and replaceable by another printing member having different printing characters to print a different message, without disassembling or partially disassembling the print head. More specifically, the arm portions can spread to receive projections on the support and return elastically to grip the projections. It is apparent that the printing member can be inserted laterally onto its related support without the need for removing a side plate and sliding the printing member onto the support member from the end of the support. In another embodiment, two coplanar supports are used to support a novel printing member. The printing member has a pair of arm portions, a bight portion and an upstanding portion disposed between the arm portions. The supports have outwardly extending projections gripped by projections on the arm portions while the upstanding portion is positioned between the supports.

DETAILED DESCRIPTION OF THE PREFERRED EMBODIMENTS

Figure 1:
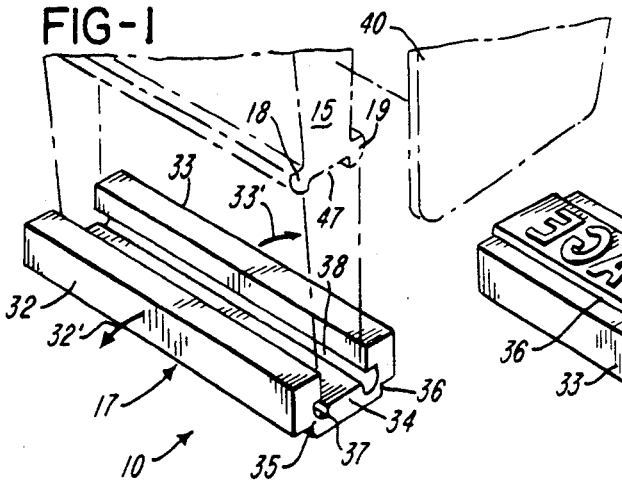
FIG. 1 is an exploded perspective view of a printing member according to the invention together with other portions of a print head.
Figure 2:
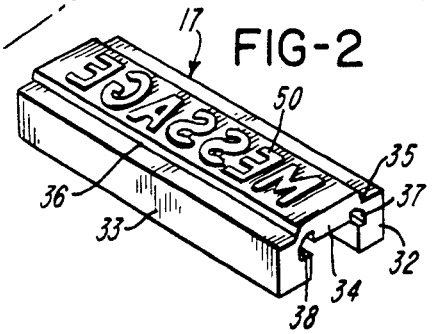
FIG. 2 is another perspective view of the printing member shown in FIG. 1.
Figure 3:
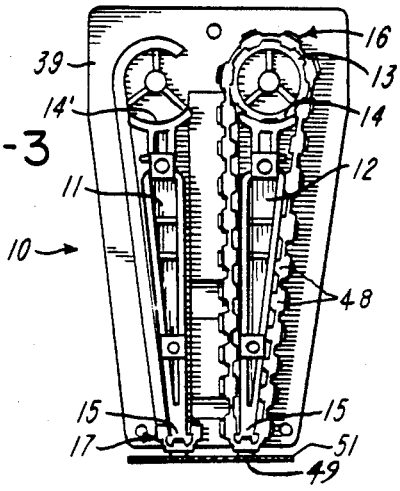
FIG. 3 is an elevational view of the print head with one side plate removed showing one line or series of printing bands and one printing member.

With reference initially to FIGS. 1 and 3, there are shown fragmentary portions of a print head generally indicated at 10. The print head 10 is shown to include a pair of mounting blocks 11 and 12 having anvils or supports 15. For the sake of economy of construction the members 11 and 12 can be identical, however, the invention can be practiced even though they are not identical. The supports 15 are disposed in reverse orientations according to the disclosure in Hamisch, Jr. U.S. Pat. No. 4,283,832. The mounting block 12 mounts a series of drive wheels 13 which are craddled on a concave support surface 14. A series of printing bands generally indicated at 16 extend about the drive wheels 13 and the support 15. Although only one drive wheel 13 and one printing band 16 can be seen in FIG. 3, it is clear that a series of drive wheels 13 and printing bands 16 is provided as in U.S. Pat. No. 4,283,832.

The support 15 for example includes support members 18 and 19 with lands 20 and 21 which provide support surfaces. The support members 18 and 19 also provide outwardly extending projections. Both supports 15 are elongate as indicated in FIG. 1. It is an advantage that both supports 15 can be made of the same configuration to provide the same support characteristics for the printing members 16 and a printing member generally indicated at 17. One of the supports 15 is shown in greater detail in FIGS. 1 and 5 and, as indicated above and as shown in the drawings, has the same contour as the other support 15. It is to be understood that the support 15 is shown greatly enlarged in FIG. 5 for the sake of clarity. The lands 20 and 21 terminate at abrupt edges 22 and 23. The support members 18 and 19 have respective tapered entries 24 and 25 which merge smoothly with the lands 20 and 21. The tapered entries 24 and 25 are in contact with inner surfaces **24*a* and 25*a* of the printing member 17. Arm portions 32 and 33 have opposed inwardly extending projections or ridges 32*a* and 33*a* which grip the support 15 at its support members 18 and 19. Shoulders 26 and 27 join the respective tapered entries 24 and 25 at abrupt edges 28 and 29. A pair of opposed abutment shoulders 30 and 31 join the lands 20 and 21 at the abrupt edges 22 and 23**.

Figure 5:
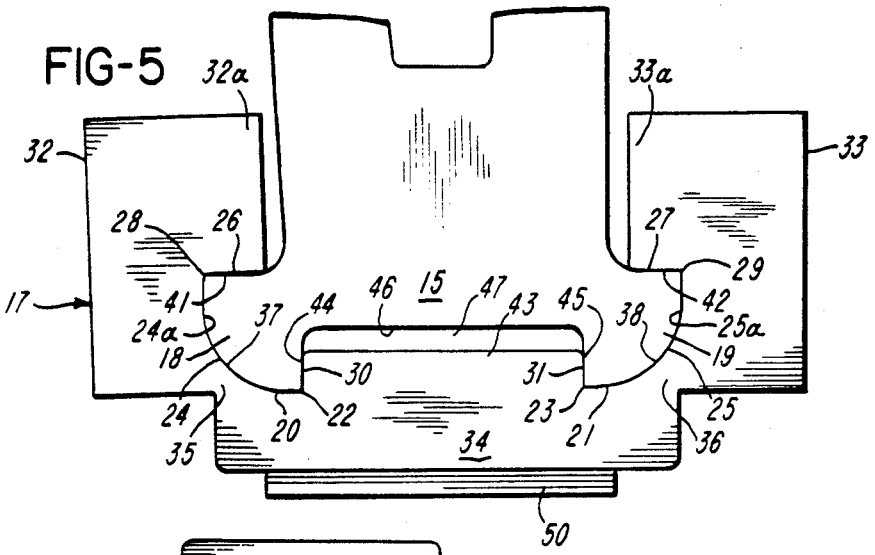
FIG. 5 is a fragmentary end elevational view of a fragmentary portion of a support and a printing member according to the invention mounted thereon.

The support 15 could support either a series of printing bands or the printing member 17 as shown in FIGS. 3 and 5 for example. The printing member 17 is shown to be elongate and extends lengthwise of the support 15 as shown in FIG. 1. The printing member 17 is shown to include the pair of arm portions 32 and 33 joined to a bight portion 34. More specifically, the arm portion 32 is connected to the bight portion 34 by a hinge portion 35 and the arm portion 33 is connected to the bight portion by a hinge portion 36. The printing member 17 has an undercut-type channel or groove 37 at the hinge portion 35 and an undercut-type channel or groove 38 at the hinge portion 36.

The print head 10 has a pair of side plates 39 and 40. The supports 15, the printing bands 16, the drive wheels 13 and the printing member 17 are straddled by the side plates 39 and 40. The printing member 17 can be inserted onto the support 15 by spreading the arm portions 32 and 33 in the direction of respective arrows 32' and 33' about respective hinge portions 35 and 36. Because of the natural resilience of the printing member 17, the arm portions 32 and 33 can pivot in directions opposite to arrows 32' and 33' about hinge portions 35 and 36 into the gripping position shown in FIGS. 3 and 5 when the bight portion 34 is positioned in the position shown in FIGS. 3 and 5. Thus, the arm portions 32 and 33 grip the respective support members 18 and 19. More specifically, shoulder 41 of the arm portion 32 contacts the shoulder 26 and the shoulder 42 of the arm portion 33 contacts the shoulder 27.

The bight portion 34 has a lug 43 which plugs into the space between shoulders 30 and 31. The lug 43 has spaced shoulers 44 and 45 which contact respective shoulders 30 and 31. As shown the shoulders 30 and 31 are parallel to each other, and the shoulders 44 and 45 are parallel to each other. The lug 43 is preferably spaced from the bottom 46 of recess 47. The recess 47 is provided by the space between shoulders 30 and 31. A transverse or lateral section through bight portion 34 is substantially the same as a transverse or lateral section through a base portion 48 of a printing band 16 so that the printing characteristics of the printing bands 16 and the printing member 17 are similar. Differences in the printing bands 16 and the printing member 17 are compensated for in part by the fact that the respective base portions 48 and 34 are supported only by spaced lands 20 and 21 of the respective supports 15 and by the fact that the base portions 48 and 34 do not bottom in the respective recesses. The printing members 16 and 17 are molded of elastomeric material, preferably of the same characteristics.

Figure 4:
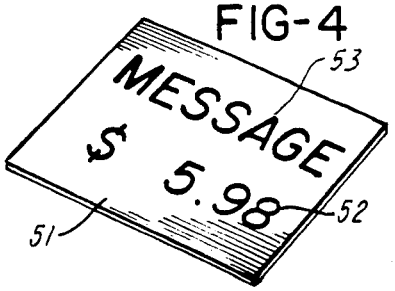
FIG. 4 is a perspective view of a record member printed by the print head shown in FIG. 3.

As shown in FIG. 3, the outer faces of characters 49 and 50 on respective base portions 48 and 34 are in a common plane or print surface and have the tendency to print uniformly on a record member 51 as shown in FIG. 4. The printing bands 16 print the variable information such as price indicated at 52 and the printing member 17 prints a message illustrated by the characters "MESSAGE" indicated at 53. The message can be the store name, or designations like "MEAT", "DELI", etc.

Figure 6:
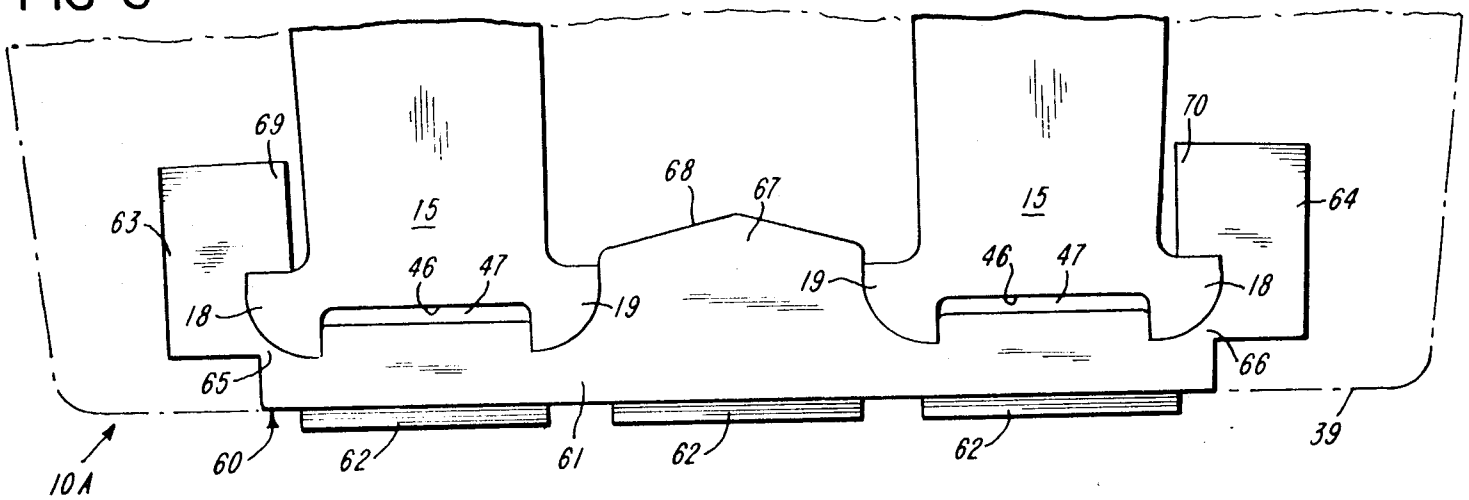
FIG. 6 is a fragmentary end elevational view showing a pair of supports for supporting a novel one-piece insertable printing member.

In the embodiment of FIG. 6, printing member 60 includes a bight portion 61 which provides a base for coplanar printing characters 62. The printing member 60 has a pair of arm portions 63 and 64 joined to the bight portion 61 by respective hinge portions 65 and 66. The supports 15 have been described above in detail. The bight portion has an upstanding portion or projection 67 having a tapered end 68. The upstanding portion 67 is disposed preferably snugly between the supports 15. The tapered end 68 facilitates insertion of the upstanding portion 67 between the supports 15. The supports 15 each have support members 18 and 19. Arm portions 63 and 64 have inwardly extending projections or ridges 69 and 70 gripped by the support members 18. The printing member 60 is supported by support members 18 of the supports 15 to maintain the printing elements 62 in a common plane or print surface. As shown the printing member 60 is generally W-shaped and provides a rather large printing area. This is accomplished without need to redesign the print head 10A which is part of a labeler (not shown). As with the printing member 17, the printing member 60 has a substantially constant section along its length.

Other embodiments and modifications of the invention will suggest themselves to those skilled in the art, and all such of these as come within the spirit of this invention are included within its scope as best defined by the appended claims.

I claim:

1. A print head having at least two identical supports, each support having a pair of outwardly extending projections and means providing a support surface, a series of printing bands extending about one of the supports, each printing band having a series of printing bases, the bases having printing elements, the printing bands being composed of elastomeric material, one printing element of each printing band being supportable at the support surface of the one support member, a longitudinally extending printing member supported by another of the supports, the printing member including a pair of spaced arm portions having terminal ends and a connecting bight portion, the arm and bight portions being in a transverse generally U-shaped arrangement, the bight portion providing a base having an outer surface, a transverse section across the base of the printing member being substantially the same as a transverse section across the base of one of the printing bands, a plurality of printing characters extending in a lengthwise direction on the outer surface, the arm portions having inner surfaces with opposed inwardly extending projections, the printing member being of one-piece molded construction and being composed of elastomeric material so that the arm portions are spreadable to enable the inwardly extending projections to clear the outwardly extending projections and to grip the outwardly extending projections when the bight portion has moved into supported relationship with respect to the other support surface, and the printing characters on the printing bands which are supported by the one support surface being coplanar with the printing characters of the printing member.

2. A print head having at least two supports, each support having a pair of outwardly extending projections and means providing a support surface, a series of printing bands extending about one of the supports, the printing bands being composed of elastomeric material, each printing band having a series of printing bases, the bases having printing elements, one printing element of each printing band being supportable at the support surface of the one support, a longitudinally extending printing member supported by another of the supports, the printing member having a pair of spaced arm portions having terminal ends and a connecting bight portion, the arm and bight portions being in a transverse generally U-shaped arrangement, the bight portion providing a base having an outer surface, a plurality of printing characters extending in a lengthwise direction on the outer surface, the arm portions having opposed inner surfaces with inwardly extending projections, the printing member being of one-piece molded construction and being composed of elastomeric material so that the arm portions are spreadable to enable the inwardly extending projections to clear the outwardly extending projections of the respective support and to return resiliently to grip the outwardly extending projections when the bight portion has moved into supported relationship with the respective support surface, the printing characters of the printing bands on the one support being in a coplanar print surface with the printing characters of the printing member on the other support, and means to provide substantially the same printing characteristics to the printing member and the printing bands including each of said supports having substantially the same construction adjacent the print surface and a transverse section across the base of the printing member being substantially the same as a transverse section across the base of one of the printing bands.

3. A print head having at least two mounting blocks, each mounting block including a support and means for providing a drive wheel mounting surface, each support having a pair of outwardly extending projections and means providing a support surface, each mounting surface being adapted to mount a series of drive wheel and to have a series of printing bands extend about the drive wheels and the related support surface but at least one but less than all of the mounting blocks having such drive wheels and printing bands, another of the mounting blocks having a printing member mounted to the support, the printing member including a pair of spaced arm portions having terminal ends and a connecting bight portion, the arm and bight portions being in a transverse generally U-shaped arrangement, the bight portion providing a base having an outer surface, a plurality of printing characters on the outer surface, the arm portions having opposed inner surfaces with inwardly extending projections, the printing bands and the printing member being composed of elastomeric material, the printing member being of one-piece molded construction, the arm portions being spreadable to enable the inwardly extending projections to clear the outwardly extending projection on the related support and to return resiliently to grip the outwardly extending projections when the bight portion has moved into supported relationship with the support surface, the printing characters of the printing band on the one support being in a coplanar print surface with the printing characters of the printing member on the other support, and means to provide substantially the same printing characteristics to the printing member and the printing bands including each of said supports having substantially the same construction adjacent the print surface and a transverse section across the base of the printing member being substantially the same as a transverse section across the base of one of the printing bands.

* * * * *

UNITED STATES PATENT AND TRADEMARK OFFICE

CERTIFICATE OF CORRECTION

PATENT NO. : 4,502,383

DATED : March 5, 1985

INVENTOR(S) : Shinsuke Okabe

It is certified that error appears in the above-identified patent and that said Letters Patent are hereby corrected as shown below:

Column 5, line 23, "wheel" should be --wheels--.

Signed and Sealed this

Ninth Day of July 1985

[SEAL]

*Attest:*

DONALD J. QUIGG

*Attesting Officer* *Acting Commissioner of Patents and Trademarks*